US007757810B2

(12) United States Patent
Sparks et al.

(10) Patent No.: US 7,757,810 B2
(45) Date of Patent: Jul. 20, 2010

(54) TRANSPARENT ACOUSTICAL LAMINATE WALL SYSTEM AND METHOD OF FORMING SAME

(75) Inventors: Amy Sparks, Grand Rapids, MI (US); Todd W. Pastrick, Spring Lake, MI (US)

(73) Assignee: Soundtech, Inc., Grand Rapids, MI (US)

( * ) Notice: Subject to any disclaimer, the term of this patent is extended or adjusted under 35 U.S.C. 154(b) by 57 days.

(21) Appl. No.: 12/061,829

(22) Filed: Apr. 3, 2008

(65) Prior Publication Data

US 2009/0250291 A1 Oct. 8, 2009

(51) Int. Cl.
*E04F 13/075* (2006.01)

(52) U.S. Cl. ..... 181/290; 52/144

(58) Field of Classification Search ..... 181/287, 181/290, 30; 52/144, 145
See application file for complete search history.

(56) References Cited

U.S. PATENT DOCUMENTS 3,597,891 A 8/1971 Martin
3,621,934 A * 11/1971 Thrasher et al. ..... 181/290
3,822,762 A 7/1974 Crispin et al
3,919,444 A 11/1975 Shayman
3,991,848 A 11/1976 Davis
4,076,100 A 2/1978 Davis
4,084,366 A 4/1978 Saylor et al.
4,248,325 A 2/1981 Georgopoulos
4,283,457 A * 8/1981 Kolsky et al. ..... 442/30
4,434,592 A 3/1984 Reneault et al.
4,441,580 A * 4/1984 Webster ..... 181/286
4,496,024 A 1/1985 Wolf et al.
4,531,609 A 7/1985 Wolf et al.
4,574,099 A 3/1986 Nixon
4,627,199 A 12/1986 Capaul
4,630,416 A 12/1986 Lapins et al.
4,635,410 A * 1/1987 Chumbley ..... 52/63
4,719,730 A 1/1988 Winkowski
4,769,179 A * 9/1988 Kato et al. ..... 252/609
4,832,152 A 5/1989 Schuelke et al.
4,943,185 A 7/1990 McGuckin et al.
4,960,184 A 10/1990 Woodward et al.
4,989,688 A 2/1991 Nelson
5,009,043 A 4/1991 Kurrasch
5,024,290 A 6/1991 Birker
5,115,616 A 5/1992 Nixon
5,166,480 A 11/1992 Bottger et al.
5,644,872 A 7/1997 Perdue
5,681,408 A * 10/1997 Pate et al. ..... 156/71
5,723,831 A 3/1998 Martin et al.
6,158,176 A 12/2000 Perdue
6,244,378 B1 6/2001 McGrath (Continued)

*Primary Examiner*—Jeffrey Donels
*Assistant Examiner*—Jeremy Luks
(74) *Attorney, Agent, or Firm*—Price, Heneveld, Cooper, DeWitt & Litton

(57) ABSTRACT

A transparent acoustical sound-absorbing, fire-retardant wall finishing system (100) includes a laminated semi-rigid acoustical planar backer board material (101). A glass textile surface covering (107) is used which includes a decorative woven or flat non-woven face (109) and back surface (111). The flexible surface covering (107) is attached to the laminated semi-rigid acoustical planar backer board material (101) at its back surface (111) so that the face of the material (109) fully covers the backer board material (101) for providing an uninterrupted secondary surface giving the appearance of a finished wall.

15 Claims, 1 Drawing Sheet

U.S. PATENT DOCUMENTS 6,256,941 B1 7/2001 Yu et al.
6,443,257 B1 9/2002 Wiker et al.
6,698,543 B2 3/2004 Golterman
6,840,349 B2 1/2005 Andre et al.
6,921,791 B2 * 7/2005 Lenox et al. ..... 525/208
6,983,821 B2 1/2006 Putt et al.
2002/0134616 A1 9/2002 Sheperd
2006/0191743 A1 * 8/2006 Pike et al. ..... 181/290
2006/0216471 A1 9/2006 Grah et al.
2007/0125011 A1 6/2007 Weir et al.
2007/0193177 A1 * 8/2007 Wilson et al. ..... 52/518

* cited by examiner

TRANSPARENT ACOUSTICAL LAMINATE WALL SYSTEM AND METHOD OF FORMING SAME

FIELD OF THE INVENTION

The present invention relates generally to fixed wall systems and more particularly to a fixed wall system utilizing a flexible glass textile wall covering and semi-rigid backer board.

BACKGROUND

Various types of wall panel systems have been commonly used in the art for covering existing walls. Acoustical panels have been attached to the wall and/or ceiling to absorb sound. These panel systems are typically used in basements and other residential applications as well as airports, lobbies, and restaurants that work to dampen unwanted noise. For example, U.S. Pat. No. 4,960,184 teaches a sound-absorbing structure formed of a sound-absorbing material, such as felt mat or fiber glass. A series of parallel, decorative non-sound-absorbing strip material is arranged in a parallel fashion across the surface of the panel. The sound-absorbing panel is exposed only in an area between the adjacent strips of the decorative material. U.S. Pat. No. 6,443,257 to Wiker et al. teaches an acoustical panel having a calendared, flame-retardant paper backing. The panel includes an acoustically absorbent, semi-rigid core which also includes a permeable first face layer. The face layer is adapted to allow acoustical energy to pass though the face layer into the absorbent core. The panel also includes a flame-retardant calendared paper backing that is applied to the core. Similarly, U.S. Pat. No. 3,991,848 to Davis teaches an acoustical board that is formed of fire-retardant materials such that a fiber glass cloth layer covers a melamine board. The fiber glass cloth works to admit sound waves into grooved areas of the underlying board in a manner to de-abilitate sound waves. Finally, U.S. Pat. No. 4,531,609 to Wolf et al. teaches a sound-absorption panel which is comprised of two pelts of fiber glass which are burned together. One pelt is deformed to a saw-tooth shape such that its teeth are bonded into grooves of the other pelt, which is essentially flat. An aluminum foil layer acts as a backing.

Thus, it should be evident that wall systems like those discussed herein work as a "picture frame," "placard," or "painting on the wall" style designs that are placed "onto" an existing finished wall surface. The prior art wall systems do not fully re-skin the surface with a total surface acoustical treatment that would include the cosmetic finish.

DETAILED DESCRIPTION

Figure 1:
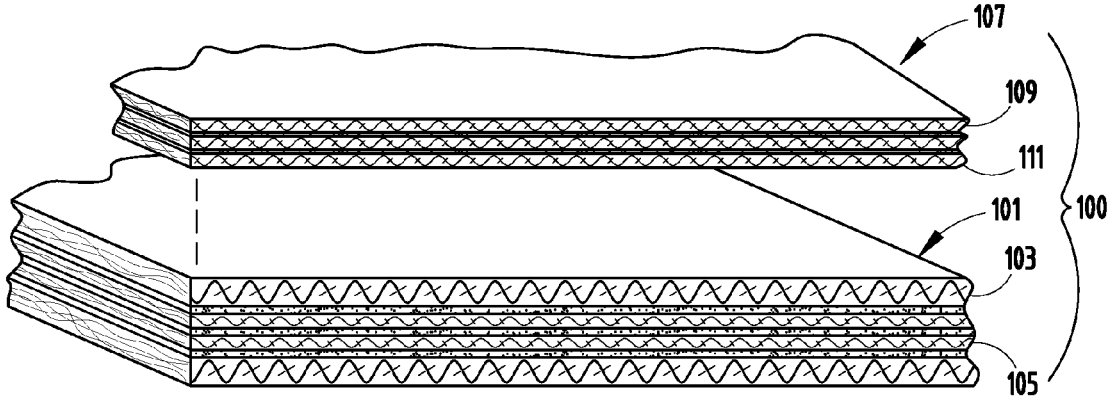
FIG. 1 illustrates a side cross-sectional view of the acoustical wall system in accordance with an embodiment of the invention.

Before describing in detail embodiments that are in accordance with the present invention, it should be observed that the embodiments reside primarily in combinations of method steps and apparatus components related to a complementary cumulative distribution driven level convergence system and method. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1 illustrates a side cross-sectional view of the transparent acoustical combined laminate wall system 100 that includes a substrate or backer layer 101. The backer layer 101 is a multi-layer tackable substrate or backer board that is enhanced by the addition of flexible glass textile facing material 107 that acts to replace the felt and or paper backed material commonly used in the prior art. The laminate system 100 may be manufactured in flat sheet or roll form that can be attached to a wall and/or ceiling with adhesive materials to form an adhesive layer. The adhesive layer may be one from a group of acrylic urethane latex, multi-purpose latex, vegetable based, pressure sensitive adhesive (PSA), and/or hot melt glue.

As seen in FIG. 1, the backer layer 101 is comprised of thin fiber glass materials having a first layer 103 and multiple second layers 105 which are adhered to one another in a layered fashion. The number of layers can vary depending on the desired acoustical results. Thus, the backer layer 101 is a laminated semi-rigid acoustical planar backer that acts to provide a supporting surface for a glass textile 107. The glass textile 107 includes a glass textile surface 109 that is essentially a decorative woven or flat non-woven face and/or back surface 111. The decorative glass textile surface 109 can be smooth or textured to provide an attractive appearance while still providing a flexible surface for covering over the backer layer 101.

Figure 2:
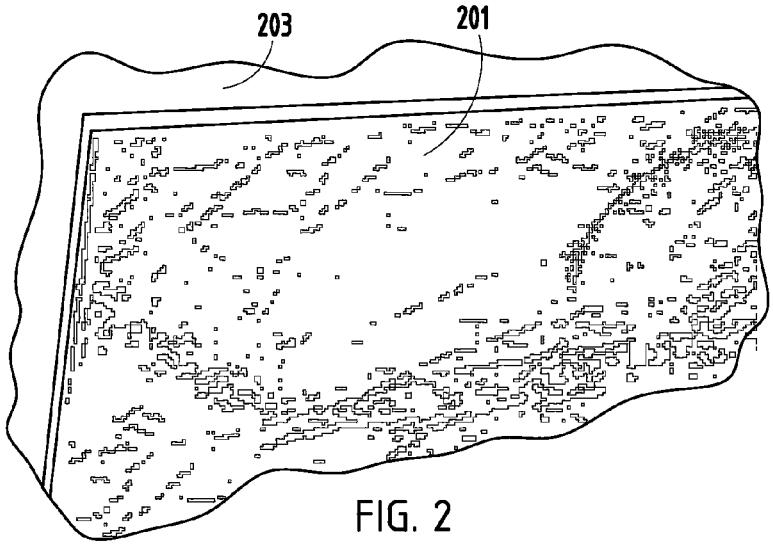
FIG. 2 illustrates a top view of the textured glass textile surface shown in FIG. 1.

FIG. 2 illustrates a top view of the textured glass textile surface shown in FIG. 1. The acoustical wall system 200 is shown where the glass textile 201 is attached to the backer layer 203 at its back surface so that the decorative woven face fully covers the backer layer 203 where desired and provides an uninterrupted secondary surface. As a further example, the glass textile 201 may be SCANDATEX material, which is manufactured by Johns Manville Corporation, which includes a decorative woven or flat non-woven face and/or back surface.

An advantage of the laminate system 100 is that it is rigid enough to allow for bridging of existing cracks, small holes, and other minor surface flaws. The laminate system 100 creates a substantially smooth, flat, and acoustically-enhanced surface in which the glass textile wall covering can be hung. After installation, the final surface can be painted with interior latex paint, and will remain breathable with multiple coats of paint. The laminate system 100 can be offered in multiple thicknesses to provide variations in acoustical and thermal performance. As will be evident to those skilled in the art, the laminate system 100 offers numerous advantages due to its superior indoor air quality and its ability to endure environmental heat, cold, and humidity. The system is sustainable, low maintenance, durable, and has decreased flammability while significantly enhancing acoustical and thermal performance over prior art wall systems.

Figure 3A:
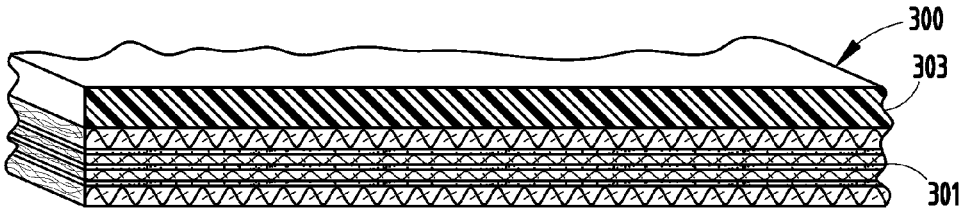
FIG. 3A and FIG. 3*b* illustrate side cross-sectional views of alternative embodiments of the backer layer as seen in FIG. 1.
Figure 3B:
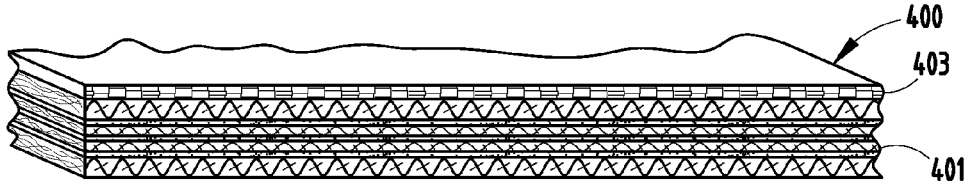

FIG. 3A and FIG. 3B illustrate side cross-sectional views of alternative embodiments of the backer layer as seen in FIG. 1. In a first alternative embodiment in FIG. 3A, a backer layer 300 that is comprised of multi-layer tack fiberglass substrate 301. A flexible substrate 303 is used over the fiber glass substrate 301 in order to provide enhanced adhesion and a greater sound transmission class (STC). The flexible substrate 303 may be made of Thermo Plastic Olefin (TPO), Ethylene Propylene Diene Monomer (EPDM), Ethylene Vinyl Acetate (EVA), Thermo Plastic Elastomeric (TPE), or similar type compounds. In a second embodiment shown in FIG. 3B, a backer layer 400 may be also used that is also comprised of a multi-layer tack fiber glass substrate 401. In this embodiment, a flexible layer 403 includes a "chip" board that covers the fiber glass substrate 401. The chip board is manufactured from a paper product or the like used to enhance STC properties.

During installation, the system can be adhered to a wall or ceiling using a latex, acrylic latex, or a pressure-sensitive or hot-melt adhesive that is either troweled, rolled, dispensed, or pressed in place for creating a complete and uninterrupted secondary surface. Subsequently, the glass textile wall covering would then be hung in conventional manner using a predefined wallpaper adhesive and/or paste material. Once these adhesives are dry, a single coat of latex primer and a single coat of latex paint (or alternatively two coats of paint) are applied to finish the surface. The result is a continuous wall system that is "finished," thereby offering a transparent solution to the end user facing stringent fire, acoustical, thermal, and air quality requirements.

After the wall system has been installed with the consumer, the outer finishing surface 201 may be replaced years later without the need to remove the entire acoustical laminate wall system. The outer decorative covering can be easily removed from the acoustical laminate wall system 100 and replaced with a new outer finishing surface. This allows consumers to change the look of the system as their preferences change. Additionally, significant damage that may have occurred to the system may be repaired with a very small out-of-pocket cost, lost revenue/usage of the space, or time investment. The outer surface can also be replaced after numerous coats of paint for allowing increased breathability of the system if it has been installed in a high humidity area or where the number of coats of paint reduce the system's acoustical value below designated consumer requirements. The sustainable design is a significant benefit to the purchasing consumer by reducing lifetime costs and is a benefit to all consumers by reducing and eliminating materials in landfills. The consumer also has the option to place a new outer finishing surface 201 over the existing outer finishing surface 201 if a desire for a design change exists. As noted herein, the additional layer of material is virtually invisible to the consumer and adds another layer of durability and fire protection to the existing wall and acoustical laminate wall system.

As a compliment to replacing the outer finishing surface the acoustical laminate wall system, the present invention also allows for easy and seamless repair to the acoustical portion of the system. In accordance with the structure of the present invention, an area of the wall system can be cut out, removed, and replaced with ease which will be substantially invisible to the end user after repair. Because of the system approach and bridging ability of the various materials, affected portions of the system can be replaced and a new outer covering 201 can be applied and the entire wall repainted to create a seamless look. Prior art systems do not allow for repair without the repair being easily detected and/or noticed by the user. If a prior art "picture frame" system is damaged, a new system must be purchased or, where there is a paneled system look, one panel can be replaced but the color variation in the fabrics or traditional coverings is very noticeable and cannot be blended or matched to what was originally installed. The system of the present invention allows the consumer to repaint as much of the system as is necessary to give a seamless, unnoticeable look. As noted herein, this sustainable design reduces the cost to the consumer as well as the waste in landfills and keeps an aesthetically pleasing appearance.

As compared with the prior art, the acoustical laminate wall system 100 of the present invention is consistently thin and can provide full wall surface coverage in a mainly inconspicuous manner to the end consumer. Thus, the present invention takes on the characteristics of a conventional painted drywall wall surface but includes a hidden acoustical pad having all the benefits of sound absorption, fire protection, and a decorative finish. Those skilled in the art will recognize that an average consumer would not be able to visually detect the presence of the acoustical wall system of the present invention as it takes on the appearance of a conventional wall. This occurs since the trim work, ceiling tiles, and framing will blend as normal in both retrofit or new construction applications.

Unlike the systems of the prior art, the present invention does not conspicuously protrude from the wall or appear in a paneled look where it is evident that a treatment has been applied to the wall's surface. The present invention is aesthetically pleasing and allows the beauty of the original architecture to remain as the focal point. Due to the thin dimension and structure of the invention, typical artwork and office furniture or other items normally attached to a wall's surface can still be attached in the same or similar manner. Prior art wall systems typically can be manufactured at no less than ½-inches in thickness and are more commonly one-inch thick or more.

Moreover, prior art wall systems typically place large, bulky, "picture frame size" panels on top of an existing surface and do not "finish" a wall. Most of the competitive products, if not all, are made to be applied in a panel format and rarely used in a layered fashion over the entire surface to form a laminate wall system. Wall systems of the prior art typically have a "paneled" or "picture frame" appearance, as compared to the present invention which appears to be transparent to the consumer. The present invention is continuous in that it appears to have no noticeable seams since the textile covering 107 transitions smoothly together as in conventional wallpaper or vinyl wall covering applications. Again, this is achieved because of the thinness of the product and its ability to blend in with standard trim work and framing. If prior art wall systems were applied in full coverage on a wall, they would bulge over trim work and ceiling tile joints making the walls, doors, and ceilings aesthetically displeasing in appearance. The present invention is manufactured of environmentally responsible materials and is fire-class rated to the UL-E84 standard test method for interior building materials. The present invention is also mold- and mildew-resistant and has high acoustical dampening properties. It is also tackable at certain thicknesses, and is dimensionally stable across the entire applied surface.

Finally, the acoustical laminate wall system allows for a fast, seamless installation over the existing substrate. Drywall seams, fastener locations, and minor imperfections may not need to be completely finished and in some instances may not need to be finished at all since the invention bridges over these imperfections. The system of the present invention minimizes volatile organic compounds (VOCs) and can be used in new construction or in a retro-fit application. In view of the thinness of the present invention, it can be installed on a pre-existing wall without altering the trim work, chair rails, ceiling joints, and tiles or making them appear out of place. The invention may be particularly useful in healthcare institutions, educational facilities, commercial properties, and/or residential applications.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential feature or element of any or all the claims. The invention is defined solely by the appended claims including any amendments made during the pendency of this application and all equivalents of those claims as issued.

We claim:

1. An acoustical sound-absorbing, fire-retardant wall finishing system comprising:

a laminated non-structural planar acoustical pad;

a flexible woven glass textile wall covering that conforms to the shape of the front surface of the non-structural planar acoustical pad;

a serviceable adhesive layer for joining the non-structural planar acoustical pad and the flexible woven glass textile; and wherein the glass textile face includes no paper material and fully covers the non-structural planar acoustical pad providing an uninterrupted secondary surface so as to show no visible seam when joined with adjacent acoustical pads that can be easily removed without damage to the non-structural planar acoustical pad for repair and replacement of the glass textile face.

2. An acoustical sound-absorbing, fire-retardant wall finishing system as in claim 1, having a front surface finish from the group of: smooth, textured and patterned, woven, and non-woven.

3. An acoustical sound-absorbing, fire-retardant wall finishing system as in claim 1, wherein the adhesive layer is one from a group of Acrylic Urethane Latex, Multi-Purpose Latex, vegetable based, and hot melt glue.

4. An acoustical sound-absorbing, fire-retardant wall finishing system as in claim 1, wherein the acoustical pad includes a rubber backer.

5. An acoustical sound-absorbing, fire-retardant wall finishing system as in claim 4, wherein the rubber backer is one from the group of Thermo Plastic Olefin (TPO), Ethylene Propylene Diene Monomer (EPDM), Ethylene Vinyl Acetate (EVA), and Thermo Plastic Elastomer (TPE).

6. An acoustical sound-absorbing, fire-retardant wall finishing system as in claim 1, wherein the non-structural planar acoustical pad has a substantially high sound transmission class (STC).

7. An acoustical sound-absorbing, fire-retardant wall finishing system comprising:

a laminated non-structural planar acoustical pad;

a flexible woven surface covering comprised of a glass textile wall covering having a decorative woven surface that conforms to the shape of the non-structural planar acoustical pad such that the decorative woven surface is removable from the non-structural planar acoustical pad and provides a complete and uninterrupted serviceable finished wall surface;

a serviceable adhesive layer for joining the non-structural planar acoustical pad and the flexible woven glass textile; and wherein the flexible surface covering includes no paper backer material and is attached to the laminated non-structural planar acoustical pad material at its back surface so that the decorative woven face fully covers the non-structural planar acoustical pad material providing a complete and uninterrupted finished wall surface so as to show no visible seam when joined with adjacent acoustical pads that can be easily removed without damage to the non-structural planar acoustical pad for repair and replacement of the glass textile face.

8. An acoustical sound-absorbing, fire-retardant wall finishing system as in claim 7, wherein the adhesive layer is one from a group of Acrylic Urethane Latex, Multi-Purpose Latex, vegetable based, and hot melt glue.

9. An acoustical sound-absorbing, fire-retardant wall finishing system as in claim 7, wherein the laminated non-structural planar acoustical pad material includes a rubber backer.

10. An acoustical sound-absorbing, fire-retardant wall finishing system as in claim 9, wherein the rubber backer is one from the group of Thermo Plastic Olefin (TPO), Ethylene Propylene Diene Monomer (EPDM), Ethylene Vinyl Acetate (EVA), or Thermo Plastic Elastomer (TPE).

11. An acoustical sound-absorbing, fire-retardant wall finishing system as in claim 7, wherein the laminated non-structural planar acoustical pad material has a substantially high sound transmission class (STC).

12. A method for making a serviceable acoustical sound-absorbing, fire-retardant wall finishing system comprising the steps of:

applying a laminated non-structural planar acoustical pad material to the entire surface of an existing wall using serviceable adhesive medium;

covering a front surface of the non-structural planar acoustical pad material with a flexible surface, woven glass textile wall covering that conforms to the front surface using an adhesive medium so as to show no visible seam when joined with adjacent acoustical pads that can be easily removed without damage to the non-structural planar acoustical pad for repair and replacement of the glass textile wall covering; and finishing the front surface of the flexible glass textile with a decorative surface material.

13. A method for making an acoustical sound-absorbing, fire-retardant wall finishing system as in claim 12, wherein the adhesive medium is one from a group of Acrylic Urethane Latex, Multi-Purpose Latex, vegetable based, and hot melt glue.

14. An acoustical sound-absorbing, fire-retardant wall finishing system as in claim 12, wherein the laminated non-structural planar acoustical pad material includes a rubber backer.

15. An acoustical sound-absorbing, fire-retardant wall finishing system as in claim 12, wherein the laminated non-structural planar acoustical pad material has a substantially high sound transmission class (STC).

* * * * *